US009259098B2

(12) United States Patent
Williams et al.

(10) Patent No.: US 9,259,098 B2
(45) Date of Patent: Feb. 16, 2016

(54) INFLATABLE PATIENT POSITIONING UNIT

(71) Applicant: Hill-Rom Services, Inc., Batesville, IN (US)

(72) Inventors: Joshua A. Williams, Harrison, OH (US); Neal Wiggermann, Batesville, IN (US); Timothy Joseph Receveur, Guilford, IN (US); Gregory W. Branson, Batesville, IN (US); Charles A. Lachenbruch, Lakeway, TX (US); Luke Gibson, Greensburg, IN (US); Rachel L. Williamson, Batesville, IN (US); Andrew R. Kerr, Cincinnati, OH (US); Kathryn Smith, Batesville, IN (US); Darrell Borgman, Batesville, IN (US); Bryan W. Wuebker, Harrison, OH (US)

(73) Assignee: Hill-Rom Services, Inc., Batesville, IN (US)

( * ) Notice: Subject to any disclaimer, the term of this patent is extended or adjusted under 35 U.S.C. 154(b) by 0 days.

(21) Appl. No.: 14/098,626

(22) Filed: Dec. 6, 2013

(65) Prior Publication Data

US 2015/0157521 A1 Jun. 11, 2015

(51) Int. Cl.

| | |
|---|---|
| ***A61G 7/015*** | (2006.01) |
| ***A47C 27/08*** | (2006.01) |
| ***A61G 7/012*** | (2006.01) |
| ***A61G 7/018*** | (2006.01) |
| ***A61G 7/075*** | (2006.01) |
| ***A61H 23/00*** | (2006.01) |
| *A61G 7/05* | (2006.01) |

(52) U.S. Cl.

CPC ..... *A47C 27/088* (2013.01); *A61G 7/012* (2013.01); *A61G 7/018* (2013.01); *A61G 7/0755* (2013.01); *A61H 23/00* (2013.01); *A61G 7/015* (2013.01); *A61G 2007/0514* (2013.01); *A61G 2203/34* (2013.01); *A61G 2210/70* (2013.01)

(58) Field of Classification Search

CPC ..... A61G 7/1025; A61G 2200/327; A61G 2203/34; A61G 7/05769; A61G 7/0755; A47C 27/088; A47C 27/081; A47C 20/021; A47C 20/022; A47C 27/10

USPC ..... 5/81.1 R, 618–619

See application file for complete search history.

(56) References Cited

U.S. PATENT DOCUMENTS

| | | | | | |
|---|---|---|---|---|---|
| 3,843,980 | A | * | 10/1974 | Rodriguez | A47C 20/021 5/630 |
| 4,227,608 | A | * | 10/1980 | Alfthan et al. | 198/630 |
| 4,271,546 | A | * | 6/1981 | Martin | A61G 7/02 4/457 |
| 4,592,589 | A | * | 6/1986 | Hellwig | 297/452.41 |
| 4,639,960 | A | * | 2/1987 | Quillen et al. | 5/710 |
| 4,839,932 | A | * | 6/1989 | Williamson | 5/615 |
| 4,914,771 | A | * | 4/1990 | Afeyan | 5/713 |
| 4,941,221 | A | * | 7/1990 | Kanzler | 5/615 |
| 4,962,552 | A | * | 10/1990 | Hasty | A61G 7/05769 137/561 A |
| 5,060,896 | A | | 10/1991 | Hobbins | |

(Continued)

*Primary Examiner* — Nicholas Polito
*Assistant Examiner* — Myles Throop
(74) *Attorney, Agent, or Firm* — Barnes & Thornburg LLP

(57) ABSTRACT

A patient support surface includes a cushion and an inflatable patient positioning unit. The cushion is adapted to support a patient. The inflatable patient positioning unit is arranged over a portion of a top side of the cushion at a foot end of the cushion. The inflatable patient positioning unit includes a plurality of positioner bladders shaped so that when inflated a distal end of each positioner bladder is taller than a proximal end of the positioner bladder.

21 Claims, 13 Drawing Sheets

(56) References Cited

U.S. PATENT DOCUMENTS 5,170,522 A * 12/1992 Walker ..... 5/615
5,231,720 A * 8/1993 Benoff ..... 5/644
5,331,698 A 7/1994 Newkirk et al.
5,509,155 A * 4/1996 Zigarac et al. ..... 5/655.3
5,530,980 A * 7/1996 Sommerhalter, Jr. A47C 20/021 5/624
5,606,754 A * 3/1997 Hand et al. ..... 5/713
5,715,548 A 2/1998 Weismiller et al.
5,745,939 A * 5/1998 Flick ..... A47C 20/021 5/490
5,790,997 A 8/1998 Ruehl
5,873,137 A * 2/1999 Yavets-Chen ..... 5/713
5,953,773 A * 9/1999 Asada et al. ..... 5/81.1 R
5,966,762 A * 10/1999 Wu ..... 5/710
6,056,353 A 5/2000 Meara
6,073,291 A * 6/2000 Davis ..... 5/711
6,155,641 A 12/2000 Frost
6,347,420 B2 2/2002 Elliott
6,413,194 B1 * 7/2002 Gant ..... A47C 7/021 482/112
6,516,480 B2 2/2003 Elliott
6,721,980 B1 4/2004 Price et al.
6,848,137 B1 * 2/2005 Barnes ..... 5/710
6,892,405 B1 * 5/2005 Dimitriu et al. ..... 5/615
6,966,081 B1 * 11/2005 Sharps et al. ..... 5/81.1 R
7,036,166 B2 5/2006 Kramer et al.
7,253,366 B2 8/2007 Bhai
7,296,312 B2 11/2007 Menkedick et al.
7,319,386 B2 1/2008 Collins et al.
7,330,127 B2 2/2008 Price et al.
7,458,119 B2 12/2008 Hornbach et al.
7,512,998 B2 4/2009 Martin et al.
7,515,059 B2 4/2009 Price et al.
7,538,659 B2 5/2009 Ulrich et al.
7,610,638 B2 11/2009 Kramer et al.
7,617,553 B1 * 11/2009 Faiola ..... A61G 7/1021 5/652
7,644,460 B2 1/2010 Calvo
7,779,547 B2 8/2010 Townsend
7,797,771 B1 9/2010 Bossen et al.
7,849,544 B2 * 12/2010 Flocard et al. ..... 5/710
8,028,359 B2 10/2011 Parson et al.
8,051,512 B2 11/2011 Teeter
8,108,957 B2 * 2/2012 Richards et al. ..... 5/600
8,127,380 B2 3/2012 Wurdeman
8,434,176 B1 * 5/2013 Harrison ..... A47C 20/021 5/630
9,066,598 B1 * 6/2015 Sears ..... A47C 16/02
2004/0189073 A1 9/2004 Chadwick et al.
2004/0193078 A1 * 9/2004 Flick et al. ..... 601/58
2006/0016016 A1 * 1/2006 Hornbach ..... 5/713
2007/0169268 A1 7/2007 Lemire et al.
2007/0210917 A1 9/2007 Collins et al.
2007/0289067 A1 * 12/2007 Buchanan et al. ..... 5/713
2008/0201851 A1 8/2008 Menkedick et al.
2009/0000033 A1 1/2009 Hempker
2009/0038074 A1 2/2009 Barthelt
2009/0044334 A1 2/2009 Parsell et al.
2009/0212925 A1 8/2009 Schuman et al.
2009/0212926 A1 8/2009 Du et al.
2009/0217080 A1 8/2009 Ferguson et al.
2009/0237264 A1 * 9/2009 Bobey et al. ..... 340/815.69
2010/0064439 A1 3/2010 Soltani
2010/0101026 A1 * 4/2010 Papaioannou ..... 5/710
2010/0244522 A1 9/2010 Fukai
2010/0293718 A1 11/2010 Wurdeman
2011/0047704 A1 3/2011 DeBraal et al.
2011/0277242 A1 11/2011 Dionne et al.
2012/0023673 A1 2/2012 Hornbach
2012/0047655 A1 3/2012 O'Keefe
2012/0060290 A1 3/2012 Jones et al.
2012/0124744 A1 5/2012 Hornbach et al.
2013/0000041 A1 * 1/2013 Receveur et al. ..... 5/618

* cited by examiner

INFLATABLE PATIENT POSITIONING UNIT

BACKGROUND

The present disclosure is related to a patient positioning unit. More specifically, the present disclosure is related to an inflatable patient positioning unit for moving a patient in a bed.

Patients supported on beds often require positioning by caregivers in the ordinary course of care. Positioning a patient on a bed may be difficult for a caregiver who must physically lift, pull, push, and/or otherwise move the patient in order to arrange the patient as desired. In order to reduce the difficulty of positioning a patient supported on a bed, mechanical devices on, in, or around the bed may be provided to assist a caregiver positioning the patient.

SUMMARY

The present application discloses one or more of the features recited in the appended claims and/or the following features which, alone or in any combination, may comprise patentable subject matter:

According to the present disclosure, a patient support surface may include a cushion adapted to support a patient and an inflatable patient positioning unit arranged over a portion of a top side of the cushion. The inflatable patient positioning unit may be located at a foot end of the cushion. The inflatable patient positioning unit may include a plurality of positioner bladders shaped so that when inflated a distal end of each positioner bladder is taller than a proximal end of the positioner bladder.

In some embodiments, positioner bladders of the inflatable patient positioning unit may be arranged to overlap one another between a head end and a foot end of the inflatable patient positioning unit when the positioner bladders are deflated. Illustratively, each positioner bladder may include a bottom panel, a top panel, and an expandable panel. The top panel may be coupled to the bottom panel along the proximal end of the positioner bladder to hold the top panel in place relative to the bottom panel along the proximal end of the positioner bladder during inflation of the positioner bladder. The expandable panel may be coupled between the top panel and the bottom panel along the distal end and along left/right sides of the positioner bladder to accommodate movement of the top panel away from the bottom panel along the distal end and left/right sides of the positioner bladder during inflation of the positioner bladder.

In some embodiments, the expandable panel of each positioner bladder may be formed to include at least one pleat. The at least one pleat may be adapted to accommodate movement of the top panel away from the bottom panel along the foot end of the positioner bladder during inflation of the positioner bladder.

In some embodiments, the cushion may include a plurality of support bladders arranged under the patient positioning unit. The support surface may include a plurality of percussion bladders arranged over the plurality of support bladders included in the cushion and arranged between the patient positioning unit and the head end of the cushion. The support surface may include a ticking encasing the cushion and the patient positioning unit.

In some embodiments, each positioner bladder may be U-shaped opening toward a head end of the cushion when viewed from above. In some embodiments, the positioner bladders may be arranged in two rows to form a V-shape opening toward a head end of the cushion when viewed from above.

According to another aspect of the present disclosure, a patient support system may include a pressurized air source, a support surface, and a controller, The support surface may include a cushion adapted to support a patient and an inflatable patient positioning unit arranged over a portion of a top side of the cushion at a foot end of the cushion. The inflatable patient positioning unit may include a plurality of positioner bladders coupled pneumatically to the pressurized air source. Each of the plurality of positioner bladders may be shaped so that when inflated a distal end of each positioner bladder is taller than a proximal end of the positioner bladder. The controller may be coupled to the pressurized air source and may be configured to operate the pressurized air source to inflate the positioner bladders included in the inflatable patient positioning unit.

In some embodiments, the controller may be configured to inflate the positioner bladders included in the inflatable patient positioning unit in a generally sequential order. As a result of inflation, the inflatable patient positioning unit may create a wave moving from the foot end of the inflatable patient positioning unit toward the head end of the inflatable patient positioning unit to push a patient lying on the support surface toward a head end of the cushion.

In some embodiments, the patient support system may also include a user interface coupled to the controller adapted to receive user inputs. The controller may be configured operate the pressurized air source to inflate the positioner bladders included in the inflatable patient positioning unit in response to receipt of a user input from the user interface associated with a push up in bed operation. In some embodiments, the positioner bladders of the inflatable patient positioning unit may be arranged to overlap one another between a head end and a foot end of the inflatable patient positioning unit when the positioner bladders are deflated.

In some embodiments, the support surface may include a plurality of percussion bladders coupled pneumatically to the pressurized air source. The plurality of percussion bladders may be arranged over the cushion between the patient positioning unit and the head end of the cushion.

In some embodiments, the controller may be configured to operate the pressurized air source to inflate the plurality of percussion bladders during at least some time during inflation of the positioner bladders included in the inflatable patient positioning unit in a generally sequential order. As a result of inflation, the torso of a patient lying on the support surface may vibrate relative to the cushion causing decreased static friction between the torso of the patient and the support surface.

In some embodiments, a user interface may be coupled to the controller and adapted to receive user inputs. The controller may be configured to operate the pressurized air source to inflate the positioner bladders and to inflate the plurality of percussion bladders in response to receipt of a user input from the user interface associated with a push up in bed function.

In some embodiments, the support surface may include a ticking. The ticking may encase the cushion, the inflatable patient positioning unit, and the plurality of percussion bladders.

In some embodiments, the controller may be configured to inflate the positioner bladders included in the inflatable patient positioning unit at generally the same time. As a result of inflation, the patient positioning unit may provide a hump adapted to reposition the lower leg and foot of a patient in a plane above the top side of the cushion.

In some embodiments, the patient support system may include a user interface. The user interface may be coupled to the controller and adapted to receive user inputs. The controller may be configured to inflate the positioner bladders included in the inflatable patient positioning unit in response to receipt of a user input from the user interface associated with a vascular position operation.

In some embodiments, the controller may be configured to inflate one of the positioner bladders included in the inflatable patient positioning unit arranged under a patient's lower legs. As a result of inflation, the patient positioning unit may support the lower legs while the feet of the patient are unsupported to provide heel relief to the patient.

In some embodiments, the patient support system may include a user interface coupled to the controller and adapted to receive user inputs. The controller may be configured to inflate one of the positioner bladders included in the inflatable patient positioning unit in response to receipt of a user input from the user interface associated with a heel relief operation.

In some embodiments, the patient support system may include a sensor coupled to the controller and configured to determine a position of the feet of a patient supported on the support surface. The controller may be configured to inflate one of the positioner bladders included in the inflatable patient positioning unit in response to receipt of a user input from the user interface associated with a position of the feet of a patient lying on the support surface. The sensor may include a pressure-sensitive pad adapted to map the pressure profile of a patient lying on the support surface.

According to another aspect of the present disclosure, a method of pushing a patient up in bed may include inflating sequentially a plurality of positioner bladders included in an inflatable patient positioning unit. The inflatable patient positioning unit may be arranged at a foot end of a support surface to create a wave moving from a foot end of the inflatable patient positioning unit toward a head end of the inflatable patient positioning unit. Each positioner bladder may be shaped so that when inflated a distal end of the positioner bladder is taller than a proximal end of the positioner bladder.

In some embodiments, the method of pushing a patient up in bed may include inflating a plurality of percussion bladders arranged to underlie a torso of a patient lying on the support surface during at least some time during inflation of the positioner bladders. As a result of inflating the plurality of percussion bladders, the torso of the patient lying on the support surface may vibrate relative to the cushion to decrease static friction between the torso of the patient and the support surface.

Additional features, which alone or in combination with any other feature(s), including those listed above and those listed in the claims, may comprise patentable subject matter and will become apparent to those skilled in the art upon consideration of the following detailed description of illustrative embodiments exemplifying the best mode of carrying out the invention as presently perceived.

BRIEF DESCRIPTION OF THE DRAWINGS

The detailed description particularly refers to the accompanying figures in which:

FIG. 1 is a side elevation view of a patient support system including a support apparatus (sometimes called a bed frame) and a support surface (sometimes called a mattress) showing a ticking included in the support surface cut away to expose a cushion and an inflatable patient positioning unit included in the support surface and suggesting that the inflatable patient positioning unit is adapted to lift the lower legs of a patient, engage the torso of the patient, and push the patient up in bed as part of the push up in bed operation when inflated as shown in FIGS. 2 and 3;

FIG. 2 is a view similar to FIG. 1 during the push up in bed operation showing a first positioner bladder included in the inflatable patient positioning unit inflated to lift the lower legs of a patient and showing second and third positioner bladders included in the inflatable patient positioning unit inflated to engage a foot end of the patient's torso before the patient is pushed up in bed as shown in FIG. 3;

FIG. 3 is a view similar to FIGS. 1 and 2 during the push up in bed operation showing additional positioner bladders included in the inflatable patient positioning unit inflated to push a patient up in bed by pushing on the foot end of the patient's torso while the patient's lower legs are lifted;

FIG. 6 is detail side elevation view of the support surface of the positioner bladders deflated prior to initiation of the push up in bed operation;

FIG. 7 is a view similar to FIG. 6 showing a first positioner bladder nearest the foot end of the patient positioning unit inflated as part of the push up in bed operation performed by the inflatable patient positioning unit;

FIG. 8 is a view similar to FIGS. 6 and 7 showing a second positioner bladder adjacent to the first positioner bladder inflated in sequence after the first positioner bladder as part of the push up in bed operation performed by the inflatable patient positioning unit;

FIG. 9 is a view similar to FIGS. 6-8 showing a third positioner bladder adjacent to the second positioner bladder inflated in sequence after the second positioner bladder as part of the push up in bed operation performed by the inflatable patient positioning unit;

FIG. 10 is a view similar to FIGS. 6-9 showing a fourth positioner bladder adjacent to the third positioner bladder inflated in sequence after the third positioner bladder as part of the push up in bed operation performed by the inflatable patient positioning unit;

FIG. 11 is a view similar to FIGS. 6-10 showing a fifth positioner bladder adjacent to the third positioner bladder inflated in sequence after the fourth positioner bladder as part of the push up in bed operation performed by the inflatable patient positioning unit;

FIG. 18 is a side elevation view of the patient support system showing a ticking included in the support surface cut away to expose the inflatable patient positioning unit and suggesting that the inflatable patient positioning unit is adapted to be inflated to reposition the lower legs of a patient to a vascular position above the head of the patient when inflated as shown in FIG. 19;

FIG. 19 is a view similar to FIG. 18 showing the positioner bladders included in the inflatable patient positioning unit inflated at generally the same time to reposition the lower legs of a patient to a vascular position above the head of the patient as part of the vascular positioning operation;

FIG. 24 is a side elevation view of the patient support system showing a ticking included in the support surface cut away to expose the inflatable patient positioning unit and suggesting that the inflatable patient positioning unit is adapted to be inflated to lift the lower legs of a patient while allowing the feet of the patient to remain relatively unsupported as shown in FIG. 25;

FIG. 25 is a view similar to FIG. 24 showing a predetermined one of the positioner bladders included in the inflatable patient positioning unit inflated to lift the lower legs of a patient while allowing the feet of the patient to remain relatively unsupported as part of the heel relief operation;

DETAILED DESCRIPTION OF THE DRAWINGS

Figure 1:
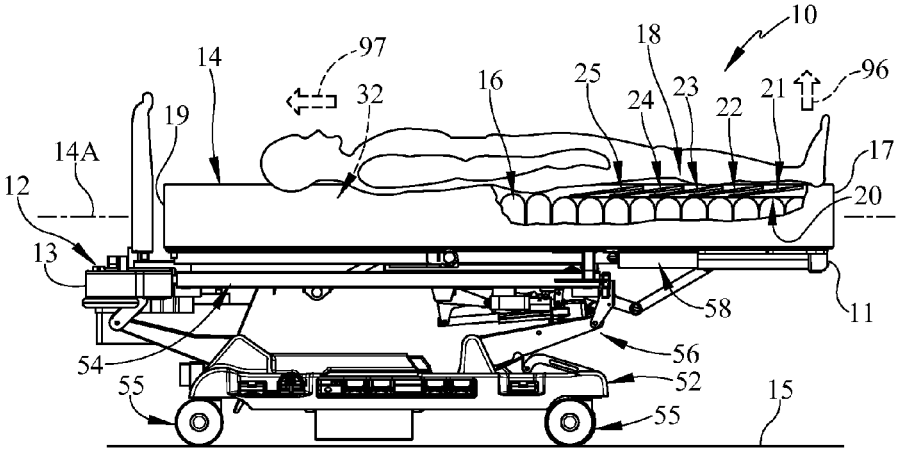
FIGS. 1-3 are a series of side elevation views of a patient support system showing an inflatable patient positioning unit included in a support surface moving a patient up in bed after the patient has migrated toward the foot end of the bed as part of a push up in bed operation.

A patient support system (bed) 10 for supporting a patient illustratively includes a support apparatus (bed frame) 12 and a support surface (mattress) 14 as shown in FIG. 1. The support apparatus 12 underlies the support surface 14 and holds the support surface 14 above a floor 15. The support surface 14 illustratively includes a cushion 16 and an inflatable patient positioning unit 18. The inflatable patient positioning unit 18 is arranged over a portion of the cushion 16 and is adapted to move a patient lying on the support system 10. In illustrative operation, the inflatable patient positioning unit 18 is adapted to push a patient up in bed as suggested in FIGS. 1-3, to lift the lower legs of a patient so that the patient assumes a vascular position as suggested in FIGS. 18 and 19, and to lift the lower legs of a patient while allowing the feet of the patient to remain relatively unsupported to provide pressure relief for the heels of the patient as suggested in FIGS. 24 and 25.

Figure 2:
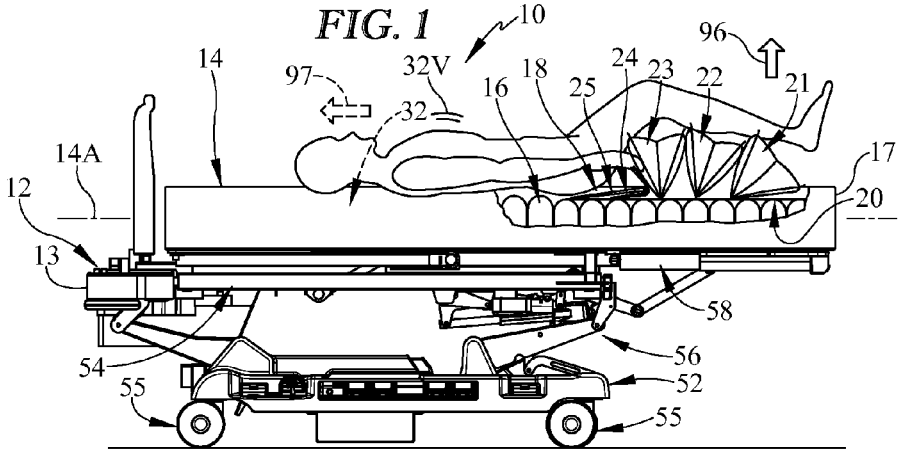

When the inflatable patient positioning unit 18 is used to push a patient up in bed, the patient positioning unit 18 first lifts a patient's lower legs and then engages the foot end of the patient's torso before pushing the patient as suggested in FIGS. 1 and 2. By lifting the legs and engaging the foot end of the torso before pushing the patient up in bed, the illustrative inflatable patient positioning unit 18 reduces friction and pushes the patient nearer the patient's center of gravity. These effects allow stable movement of the patient toward a head end of the patient support apparatus 10 (up in bed).

Figure 4:
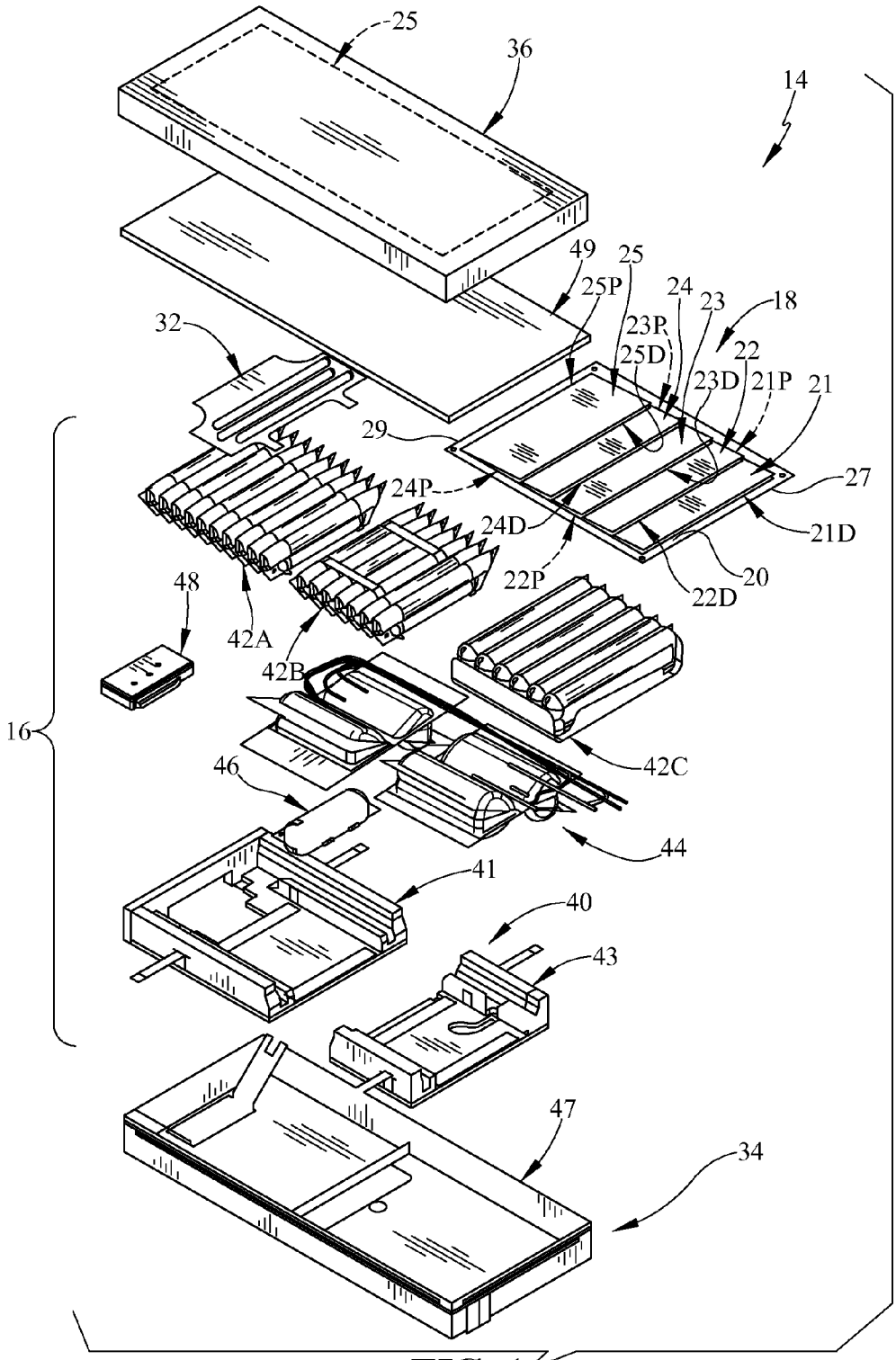
FIG. 4 is an exploded perspective view of the support surface shown in FIGS. 1-3 showing that the support surface includes a cushion having a number of foam and inflatable components adapted to support a patient, a plurality of percussion bladders adapted to provide percussion and/or vibration therapy to the torso of a patient, the inflatable patient positioning unit, and a ticking adapted to encase the cushion, the percussion bladders, and the inflatable patient positioning unit and showing that the inflatable patient positioning unit includes a base sheet and a plurality of positioner bladders coupled to the base sheet, each positioner bladder shaped so that when inflated a distal end of each positioner bladder is taller than a proximal end of the positioner bladder as shown in more detail in FIG. 11.

The inflatable patient positioning unit 18 illustratively includes a base sheet 20 and a plurality of positioner bladders 21, 22, 23, 24, 25 as shown, for example, in FIG. 4. The base sheet 20 extends over a portion of the cushion 16 at a foot end 17 of the cushion 16. The positioner bladders 21, 22, 23, 24, 25 are each coupled along a proximal end 21P, 22P, 23P, 24P, 25P to the base sheet 20. The positioner bladders 21, 22, 23, 24, 25 of the inflatable patient positioning unit 18 are arranged to overlap at least a portion of one another between a head end 29 and a foot end 27 of the inflatable patient positioning unit 18 when the positioner bladders 21, 22, 23, 24, 25 are deflated.

Figure 13:
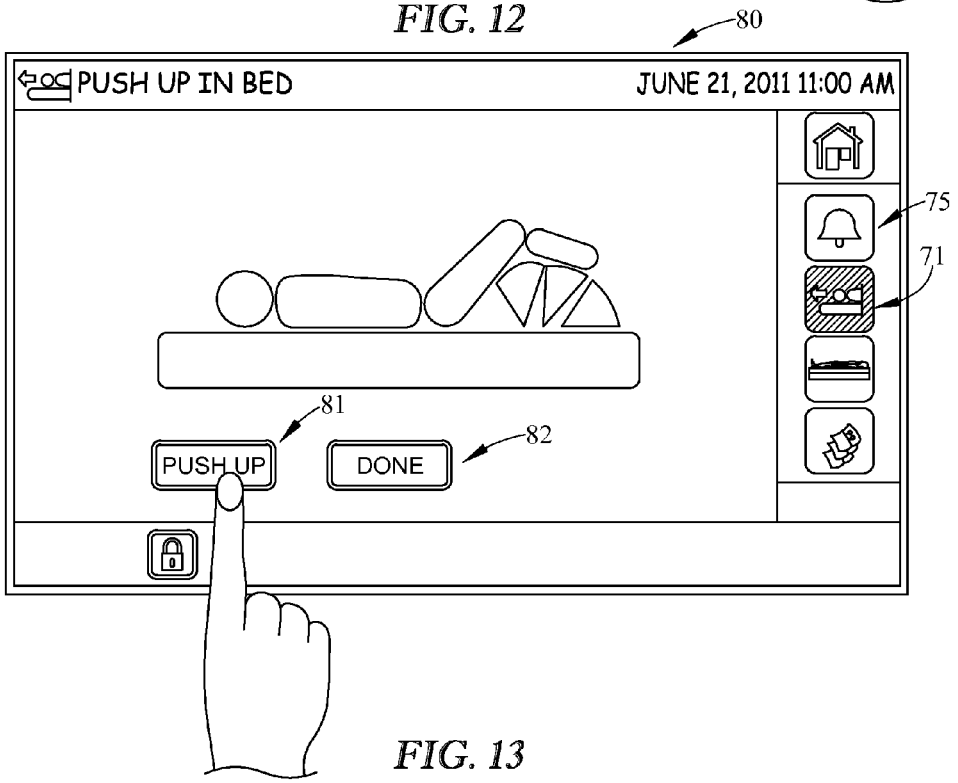
FIG. 13 is a push-up-in-bed screen from a user interface associated with the patient support system showing a user selecting a push up button used to initiate and maintain the push up in bed operation performed by the inflatable patient positioning unit of FIGS. 1-11.

Each positioner bladder 21, 22, 23, 24, 25 is shaped so that when inflated a distal end 21D, 22D, 23D, 24D, 25D the positioner bladder 21, 22, 23, 24, 25 is taller than the proximal end 21P, 22P, 23P, 24P, 25P of the positioner bladder 21, 22, 23, 24, 25 as shown in FIG. 13. The shape of the positioner bladders 21, 22, 23, 24, 25 provides means for moving a patient lying on the support system 10 so that the patient is lifted and/or pushed to a desired position on the support system 10.

In the illustrative embodiment, each positioner bladder 21, 22, 23, 24, 25 includes a bottom panel 26, a top panel 28, and an expandable panel 30 as shown in FIG. 13. The top panel 28 is coupled to the bottom panel 26 along the proximal end 21P, 22P, 23P, 24P, 25P of the positioner bladder 21, 22, 23, 24, 25 to hold the top panel 28 in place relative to the bottom panel 26 along the proximal end 21P, 22P, 23P, 24P, 25P of the positioner bladder 21, 22, 23, 24, 25 during inflation of the positioner bladder 21, 22, 23, 24, 25. The expandable panel 30 is coupled between the top panel 28 and the bottom panel 26 and is adapted to accommodate movement of the top panel 28 away from the bottom panel 26. The coupling of the top panel 28 to the bottom panel 26 causes the top panel 28 to pivot about the proximal end 21P, 22P, 23P, 24P, 25P of a corresponding positioner bladder 21, 22, 23, 24, 25.

The expandable panel 30 is coupled between the top panel 28 and the bottom panel 26 along the distal end 21D, 22D, 23D, 24D, 25D and along left and right sides of the positioner bladder 21, 22, 23, 24, 25 as suggested in FIG. 13. The expandable panel 30 accommodates movement of the top panel 28 away from the bottom panel 26 along the distal end 21D, 22D, 23D, 24D, 25D of the positioner bladder 21, 22, 23, 24, 25 during inflation of the positioner bladder 21, 22, 23, 24, 25. In the illustrative embodiment, the expandable panel 30 of each positioner bladder 21, 22, 23, 24, 25 is formed to include at least one pleat (or fold) so that each positioner bladder 21, 22, 23, 24, 25 is a bellows-type bladder adapted to accommodate movement of the top panel 28 away from the bottom panel 26. In other embodiments, the expandable panel may be made from an elastic material without any pleats or folds.

In some embodiments, a series of elastic bands 21B, 22B, 23B, 24B, 25B included in the inflatable patient positioning unit 18 extend from the top panel 28 of a corresponding bladder 21, 22, 23, 24, 25 to the base sheet 20 as suggested in FIGS. 6-11. Each of the elastic bands 21B, 22B, 23B, 24B, 25B is arranged to pull the corresponding top panel 28 toward the base sheet 20 so that the bladders 21, 22, 23, 24, 25 are reset to their original position after being inflated and deflated so that they are properly positioned for future use.

Turning now to FIG. 4, the support surface 14 illustratively includes the cushion 16, the inflatable patient positioning unit 18, percussion bladders 32, a ticking (or cover) 34, and a topper 36. The cushion 16 includes a number of components adapted to support a patient. As noted above, the inflatable patient positioning unit 18 extends over a portion of the cushion 16 and is adapted to move a patient lying on the support surface 14. The percussion bladders 32 extend over another portion of the cushion 16 between the inflatable patient positioning unit 18 and a head end 19 of the cushion 16. The percussion bladders 32 are adapted to be inflated/deflated so that the torso of a patient lying on the support surface 14 vibrates relative to the cushion 16. The ticking 34 encases the cushion 16, the inflatable patient positioning unit 18, and the percussion bladders 32. The topper 36 extends over a top side of the ticking 34 and is illustratively adapted to conduct cooling air along the interface of the support surface 14 and a patient.

Figure 5:
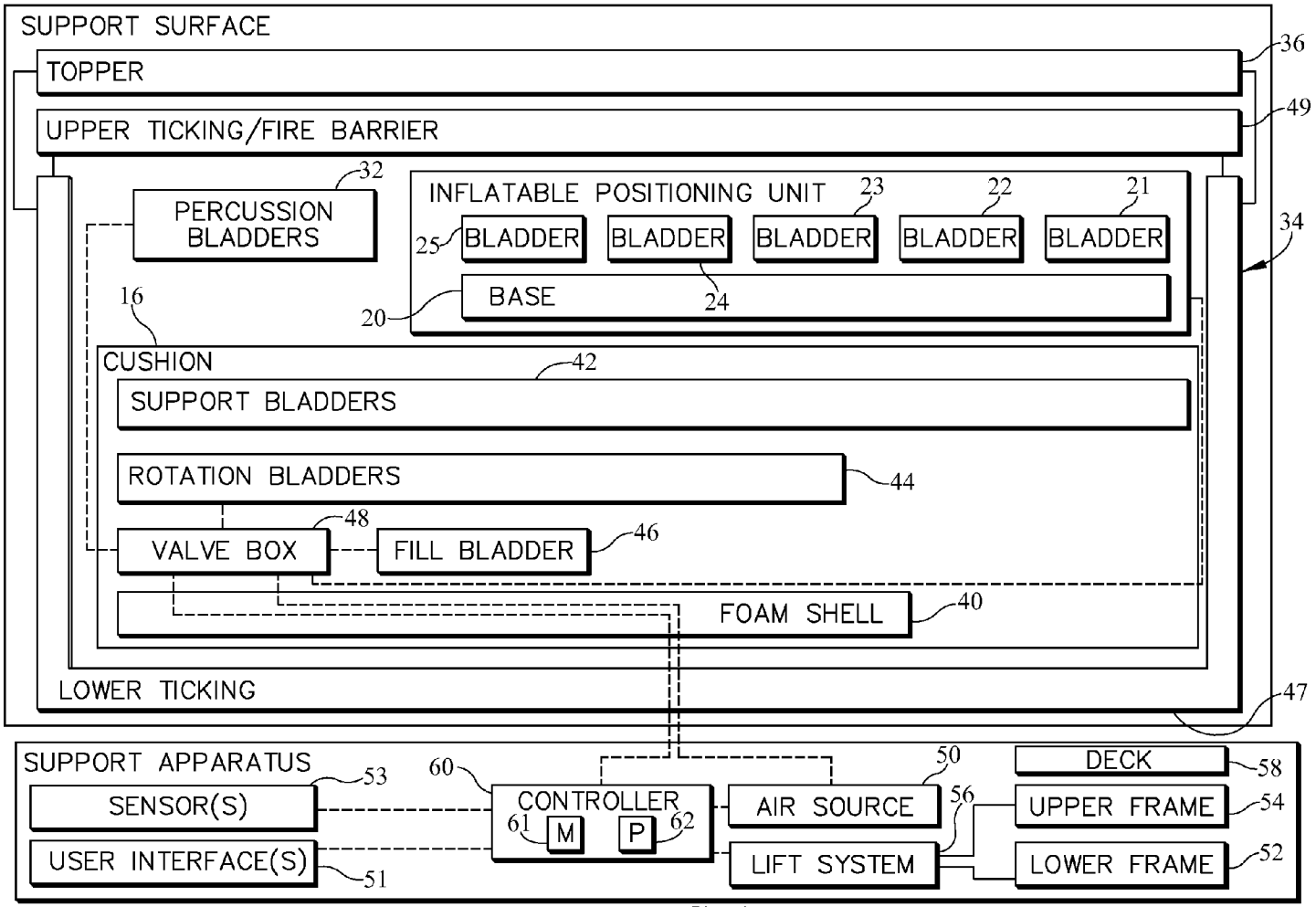
FIG. 5 is a diagrammatic view of the patient support system shown in FIGS. 1-3 showing that the support apparatus includes an air source and a controller coupled to the air source and showing that the air source is coupled to the cushion, the percussion bladders, and the inflatable patient positioning unit included in the support surface via a valve box.
Figure 6:
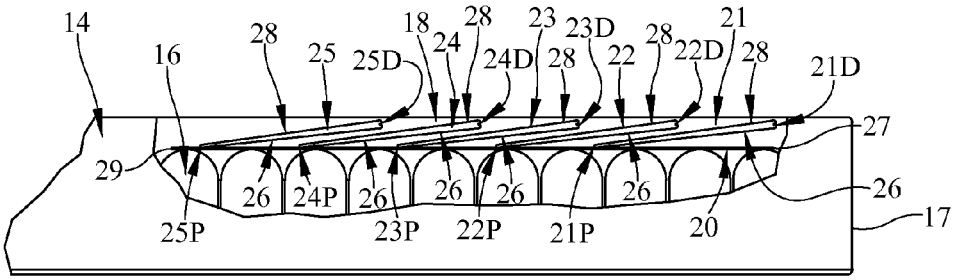
FIGS. 6-11 are a series of detail views of the support surface of FIGS. 1-3 with a portion of the ticking cut away showing the sequential inflation of the positioner bladders included in the inflatable patient positioning unit to move a patient up in bed after migration toward the foot end of the support surface during the push up in bed operation.
Figure 7:
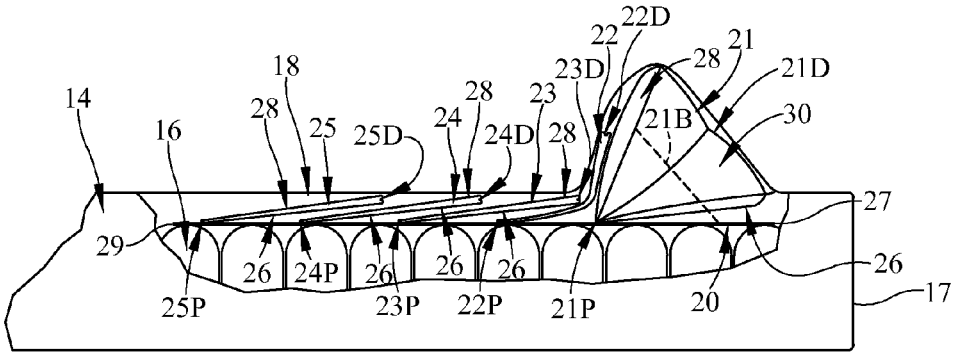
Figure 8:
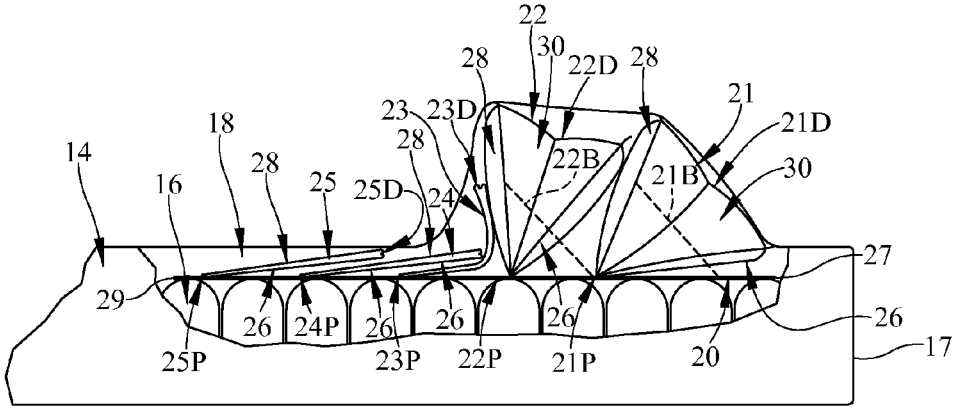
Figure 9:
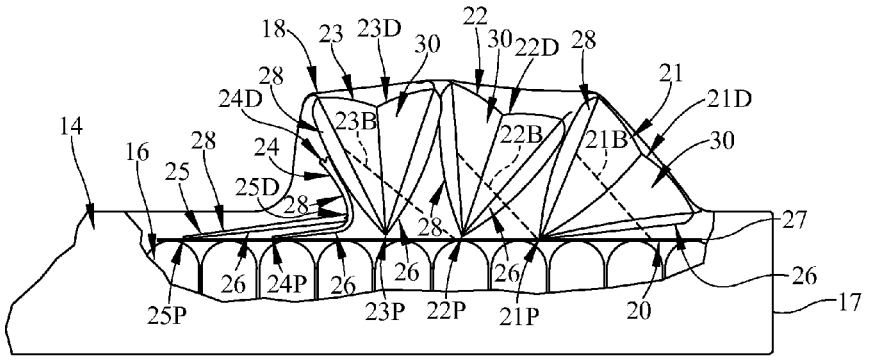
Figure 10:
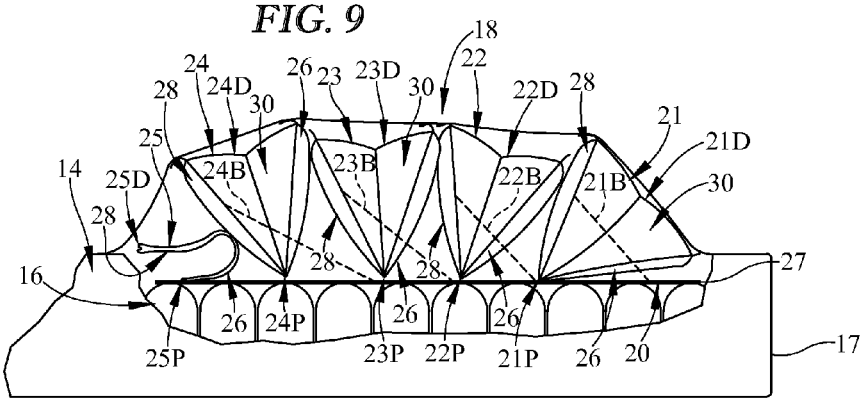
Figure 11:
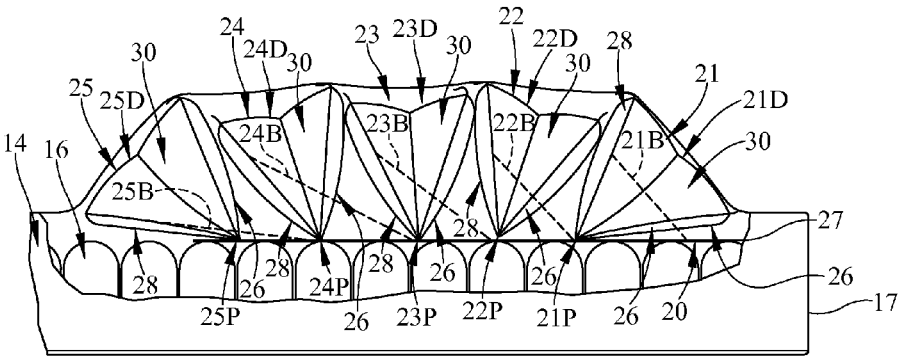
Figure 12:
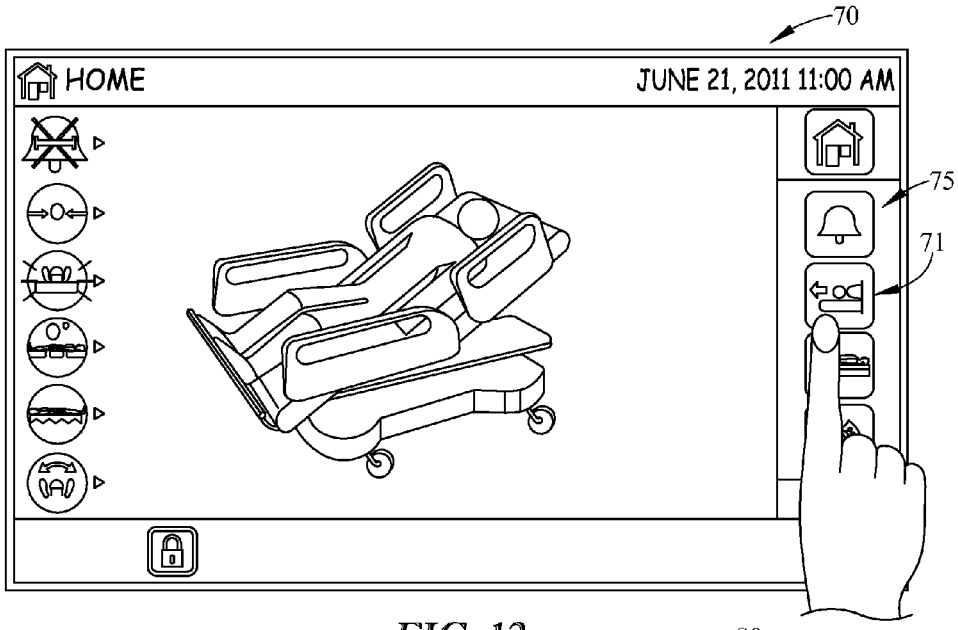
FIG. 12 is a home screen from a user interface associated with the patient support system showing a user selecting a push-up-in-bed button from a menu to access a push-up-in-bed screen as shown in FIG. 13.

The cushion 16 illustratively includes a foam shell 40, support bladders 42, rotation bladders 44, and a fill bladder 46, and a valve box 48 as shown in FIGS. 4 and 5. The foam shell 40 is illustratively made up of first and second portions 41, 43 as shown in FIG. 4. The support bladders 42 are configured to be inflated to support a patient lying on the support surface 14. Support bladders 42 are divided into head bladders 42A, seat bladders 42B, and foot bladders 42C as shown in FIG. 4. The rotation bladders 44 are positioned below the support bladders 42 and are configured to inflate to rotate a patient on the support surface 14 about a longitudinal axis 14A of the support surface 14. The fill bladder 46 is located below the support bladders 42 and is configured to fill a gap formed between the support bladders 42 when the support apparatus 12 is repositioned. The valve box 48 is pneumatically coupled to each of the inflatable components of the support surface 14.

The ticking 34 illustratively includes a lower ticking 47 and an upper ticking 49 coupled to the lower ticking 47 as shown in FIG. 4. The lower ticking 47 and upper ticking 49 cooperate to encase the cushion 16, the inflatable patient positioning unit 18, and the percussion bladders 32. The upper ticking 49 is illustratively adapted to provide a fire barrier as suggested in FIG. 5. In other embodiments, the inflatable patient positioning unit 18 and/or the percussion bladders 32 may be arranged outside the ticking 34 as part of a removable accessory system.

Further description of the components of the cushion 16 and of the entire support system 10 are included in U.S. patent application Ser. No. 13/922,982 to Meyer et al., filed on Jun. 20, 2013, which is hereby incorporated by reference herein in its entirety. In other embodiments, the cushion 16 may include other combinations of foam and/or inflatable components.

Referring again to FIG. 1, the support apparatus (bed frame) 12 illustratively includes a lower frame 52, an upper frame 54, a lift system 56, and a deck 58. The lower frame 52 includes wheels 55 and engages the floor 15. The upper frame 54 is supported above the lower frame 52. The lift system 56 interconnects the lower frame 52 with the upper frame 54 and is configured to raise and lower the upper frame 54 relative to the lower frame 52. The deck 58 is mounted to the upper frame 54 and includes a plurality of articulatable sections that move to reconfigure the profile of the deck 58.

The support apparatus 12 also includes a pressurized air source 50, a user interface 51, a plurality of sensors 53, and a controller 60 as shown, diagrammatically in FIG. 5. The air source 50 may be a compressor, a blower, or the like adapted to provide pressurized air. The user interface 51 is illustratively a touch-screen interface that displays interactive screens such as those shown in FIGS. 12, 13, 20, 21, 26, and 27. The sensors illustratively monitor the pressure in the bladders of the support surface 14, the height of the upper frame 54, and the arrangement of the deck 58. The controller 60 is coupled to the air source 50, the user interface 51, the sensors 53, and to the valve box 48. The controller 60 illustratively includes a memory 61 and a processor 62 coupled to the memory 61. The processor 62 is configured to perform instructions recorded in the memory 61.

Figure 3:
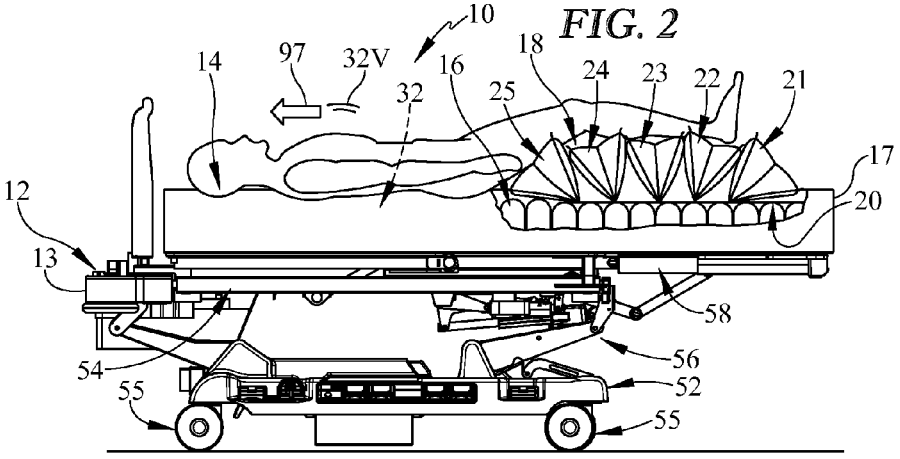

A push up in bed operation provided by the patient support system 10 moves a patient who has migrated toward a foot end 11 of the patient support system 10 back toward a head end 13 of the patient support system 10 as suggested in FIGS. 1-3. During the push up in bed operation, the controller 60 is configured to operate the valve box 48 and the pressurized air source 50 to inflate the positioner bladders 21, 22, 23, 24, 25 in a generally sequential order from the foot end 27 to the head end 29 of the inflatable patient positioning unit 18. As a result of the sequential inflation of the positioner bladders 21, 22, 23, 24, 25, the inflatable patient positioning unit 18 creates a wave moving from the foot end 27 of the inflatable patient positioning unit 18 toward the head end 29 of the inflatable patient positioning unit 18 to push a patient lying on the support surface 14 toward a head end of the cushion 16.

The shape and arrangement of the positioner bladders 21, 22, 23, 24, 25 causes the lower legs of the patient to be lifted up during a first phase of inflation as suggested by arrow 96 in FIG. 2. During the first phase of inflation, the interface between the positioner bladders 21, 22, 23, 24, 25 and the patient's lower legs moves toward the head end 29 of the inflatable patient positioning unit 18 to reduce shear forces as the patient's legs naturally bend. The shape and arrangement of the positioner bladder 21, 22, 23, 24, 25 also causes the foot end of a patient's torso to be engaged by the top panel 28 of a positioner bladder 21, 22, 23, 24, 25 in a second phase of inflation. The shape and arrangement of the positioner bladder 21, 22, 23, 24, 25 then causes a hand off of engagement with the foot end of the patient's torso during a third phase of inflation in which the patient is pushed up in bed as suggested by arrow 97 in FIG. 3.

During the push up in bed operation, the controller 60 is configured to operate the valve box 48 and the pressurized air source 50 to inflate the plurality of percussion bladders 32 so that the torso of a patient lying on the support surface vibrates relative to the cushion 16. Vibration of the torso of the patient relative to the cushion 16 results in decreased static friction between the torso of the patient and the support surface 14. As a result of the decreased static friction, lower shear forces are induced on the torso of the patient during movement toward the head end 19 of the cushion 16.

The controller 60 is configured operate the pressurized air source 50 to inflate the positioner bladders 21, 22, 23, 24, 25 during the push up in bed operation in response to receipt of a user input from the user interface 51. In the illustrative embodiment, a caregiver selects a push-up-in-bed button 71 from a menu 75 included in a home screen 70 displayed on the user interface 51 to access a push-up-in-bed screen 80 as suggested in FIG. 12. On the push-up-in-bed screen 80, the caregiver selects a push up button 81 to initiate the push up in bed operation. When a patient is moved sufficiently toward the head end 19 of cushion 16, the caregiver selects a done button 82 to stop the push up in bed operation and to deflate the positioner bladders 21, 22, 23, 24, 25.

In the illustrative embodiment, the controller 60 checks the height of the upper frame 54 and the arrangement of the deck 58 before inflating the positioner bladders 21, 22, 23, 24, 25. In particular, the illustrative controller 60 requires that the upper frame 54 be at its lowerest height and that the deck 58 be arranged in a substantially flat configuration before inflating the positioner bladders 21, 22, 23, 24, 25 to push a patient up in bed. In other embodiments, the controller 60 may allow inflation of the positioner bladders 21, 22, 23, 24, 25 while the upper frame 54 is at various other heights and while the deck 58 is arranged in various other configurations.

Figure 14:
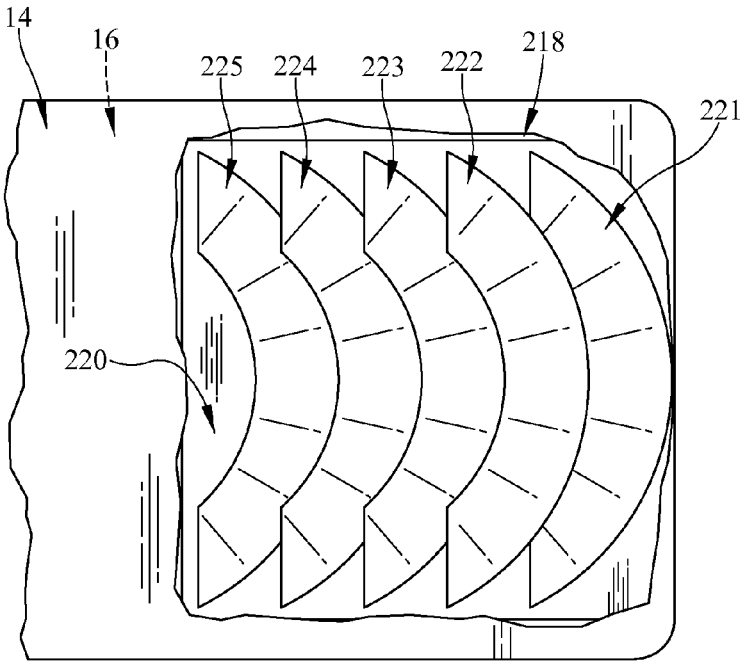
FIG. 14 is a top plan view of another inflatable patient positioning unit included in a support surface showing that the inflatable patient positioning unit includes a plurality of positioner bladders that are U-shaped opening toward a head end of the cushion when viewed from above.
Figure 15:
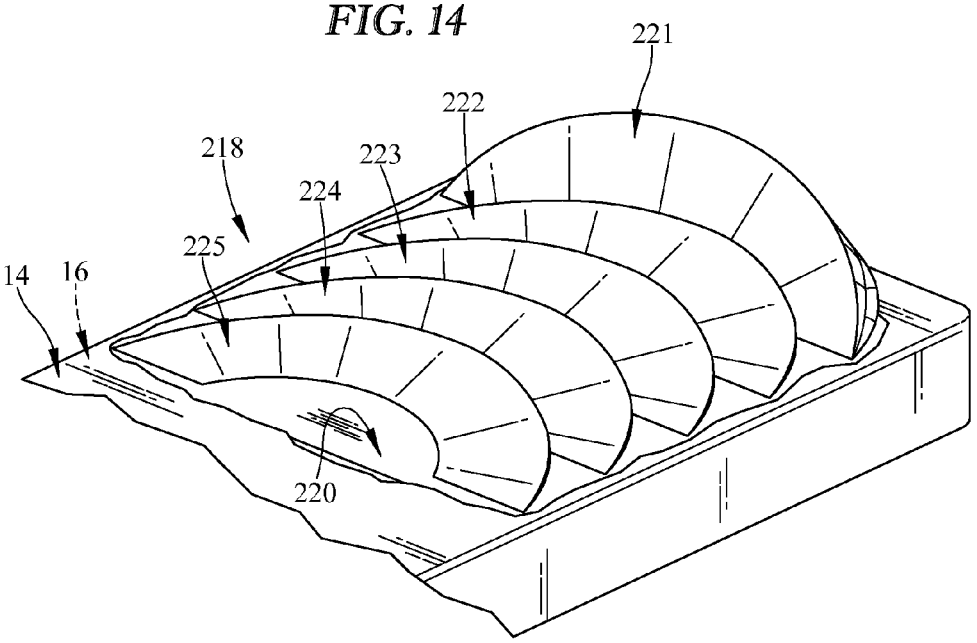
FIG. 15 is a perspective view of the inflatable patient positioning unit of FIG. 14.

Another illustrative inflatable patient positioning unit 218 is shown in FIGS. 14 and 15. The inflatable patient positioning unit 218 is configured for use in support surface 14 of patient support system 10 and is substantially similar to the inflatable patient positioning unit 18 shown in FIGS. 1-11 and described herein. Accordingly, similar reference numbers in the 200 series indicate features that are common between the inflatable patient positioning unit 18 and inflatable patient positioning unit 218. Further the inflatable patient positioning unit 218 may be used to perform each of the operations provided by inflatable patient positioning unit 18 described herein. The description of the patient support system 10 and the inflatable patient positioning unit 18 are hereby incorporated by reference to apply to the inflatable patient positioning unit 218, except in instances when it conflicts with the specific description and drawings of the inflatable patient positioning unit 218.

The inflatable patient positioning unit 218 included in the support surface 14 includes a plurality of positioner bladders 221, 222, 223, 224, 225 as shown in FIGS. 14 and 15. Each of the positioner bladders 221, 222, 223, 224, 225 are U-shaped opening toward the head end 19 of the cushion 16 when viewed from above. As a result of the U-shape of the positioner bladders 221, 222, 223, 224, 225, a patient being moved toward the head end 19 of the cushion 16 is encouraged to remain near the center of the support surface 14 rather than move to the left or right sides of the support surface 14.

Figure 16:
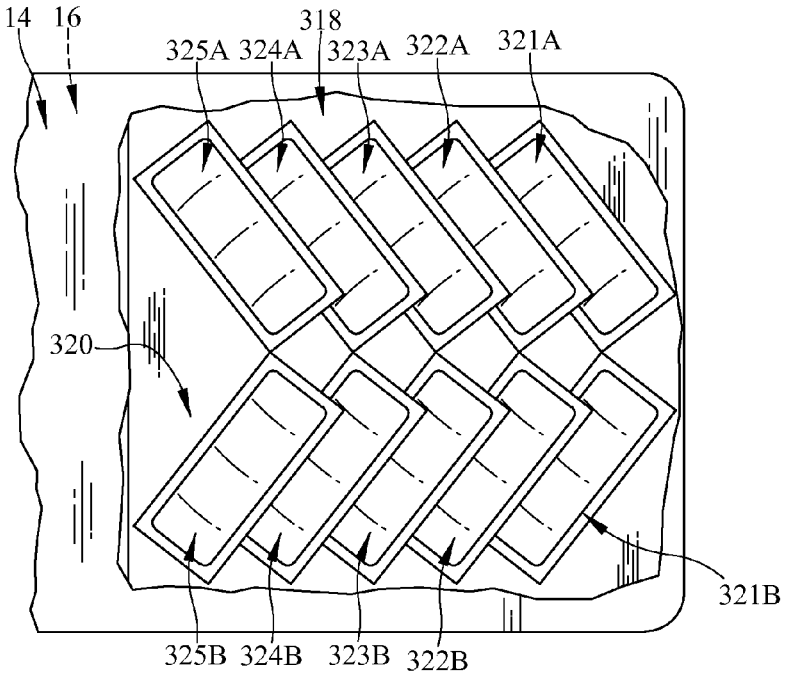
FIG. 16 is a top plan view of yet another inflatable patient positioning unit included in a support surface showing that the inflatable patient positioning unit includes a plurality of positioner bladders arranged in two rows to form a V-shape opening toward a head end of the cushion when viewed from above.
Figure 17:
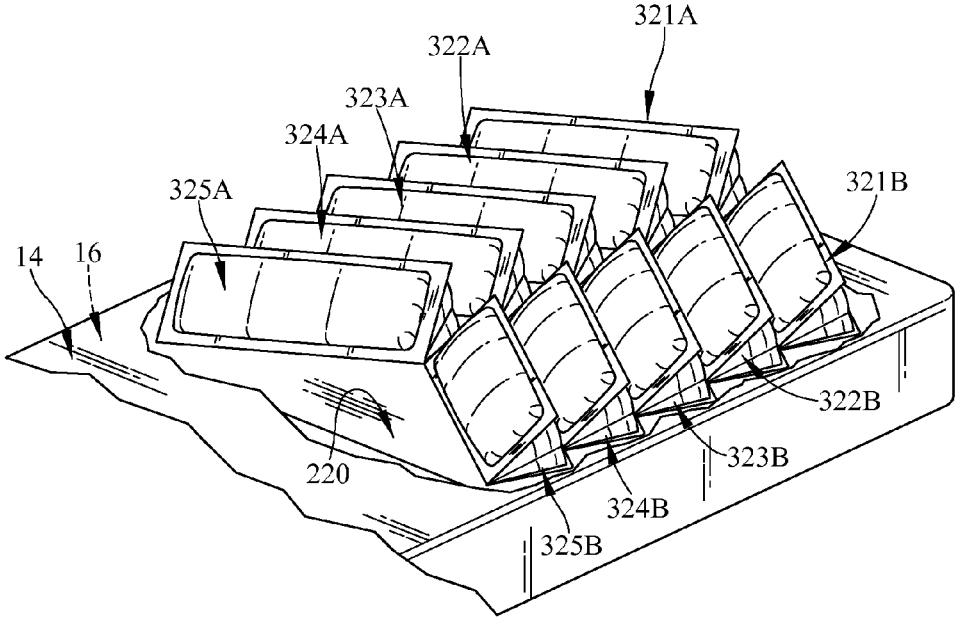
FIG. 17 is a perspective view of the inflatable patient positioning unit of FIG. 16.

Yet another illustrative inflatable patient positioning unit 318 is shown in FIGS. 16 and 17. The inflatable patient positioning unit 318 is configured for use in support surface 14 of patient support system 10 and is substantially similar to the inflatable patient positioning unit 18 shown in FIGS. 1-11 and described herein. Accordingly, similar reference numbers in the 300 series indicate features that are common between the inflatable patient positioning unit 18 and inflatable patient positioning unit 318. Further the inflatable patient positioning unit 318 may be used to perform each of the operations provided by inflatable patient positioning unit 18 described herein. The description of the patient support system 10 and the inflatable patient positioning unit 18 are hereby incorporated by reference to apply to the inflatable patient positioning unit 318, except in instances when it conflicts with the specific description and drawings of the inflatable patient positioning unit 318.

The inflatable patient positioning unit 318 included in the support surface 14 includes a plurality of positioner bladders 321A, 321B, 322A, 322B, 323A, 323B, 324A, 324B, 325A, 235B as shown in FIGS. 16 and 17. Each of the positioner bladders 321A, 321B, 322A, 322B, 323A, 323B, 324A, 324B, 325A, 235B are arranged in two rows to form a V-shape opening toward a head end of the cushion 16 when viewed from above. As a result of the arrangement of the positioner bladders 321A, 321B, 322A, 322B, 323A, 323B, 324A, 324B, 325A, 235B, a patient being moved toward the head end 19 of the cushion 16 is encouraged to remain near the center of the support surface 14 rather than move to the left or right sides of the support surface 14.

Figure 18:
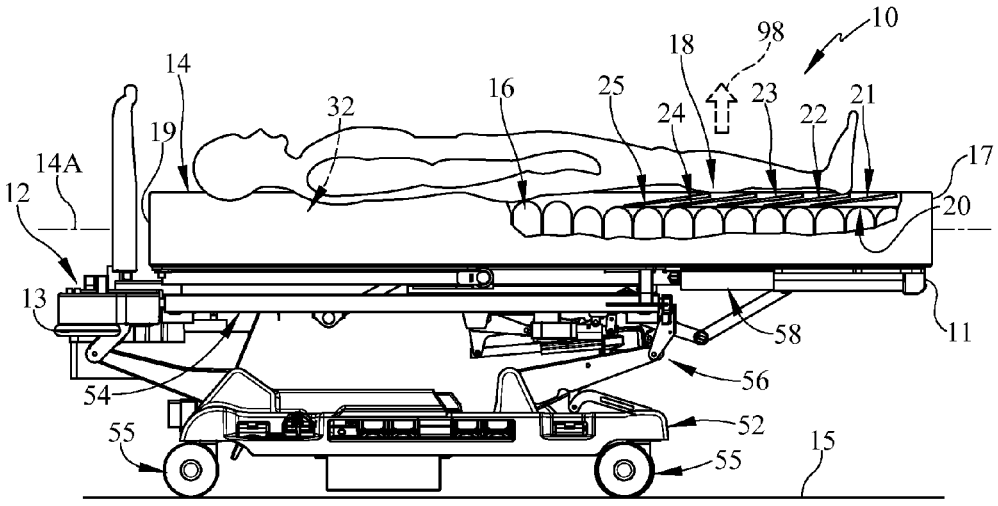
FIGS. 18-19 are a series of side elevation views of the patient support system of FIGS. 1-3 showing the inflatable patient positioning unit repositioning the lower legs of a patient to a vascular position above the head of the patient as part of a vascular positioning operation.
Figure 19:
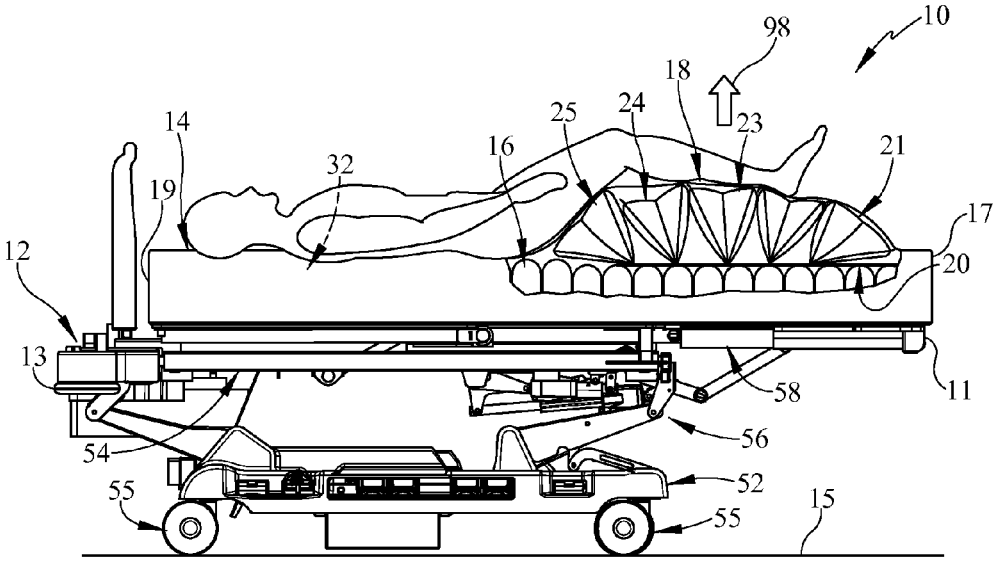

A vascular positioning operation provided by the patient support system 10 lifts and supports the lower legs of a patient to a vascular position above the head of the patient as suggested by arrow 98 shown in FIGS. 18-19. During the vascular positioning operation, the controller 60 is configured operate the valve box 48 and the pressurized air source 50 to inflate the positioner bladders 21, 22, 23, 24, 25 included in the inflatable patient positioning unit 18 at generally the same time so that the patient positioning unit 18 provides a hump as shown in FIG. 19. The hump is sized to reposition the lower leg and foot of a patient in a plane above the top side of the cushion 16.

Figure 20:
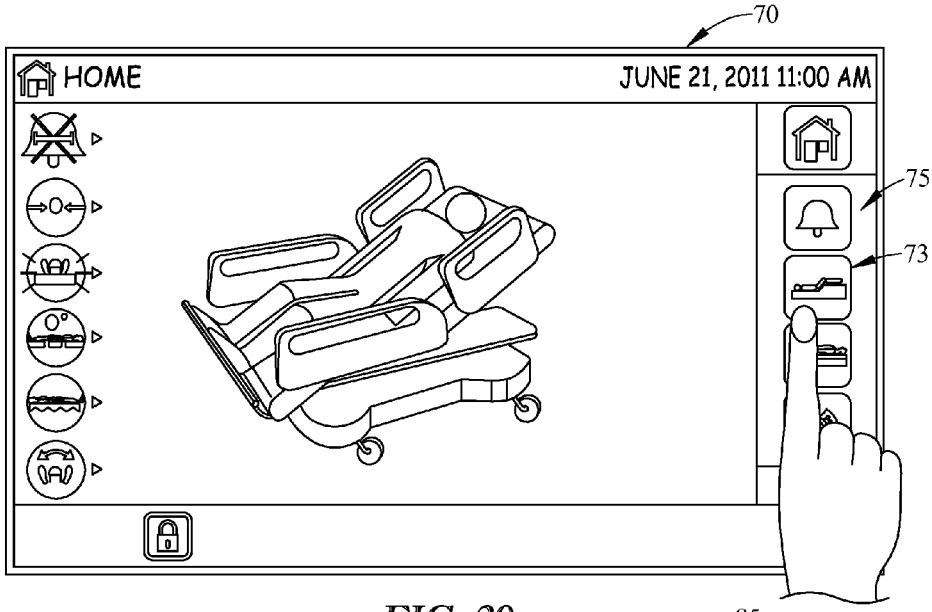
FIG. 20 is a home screen from a user interface associated with the patient support system showing a user selecting a vascular position button from a menu to access a vascular position screen as shown in FIG. 21.
Figure 21:
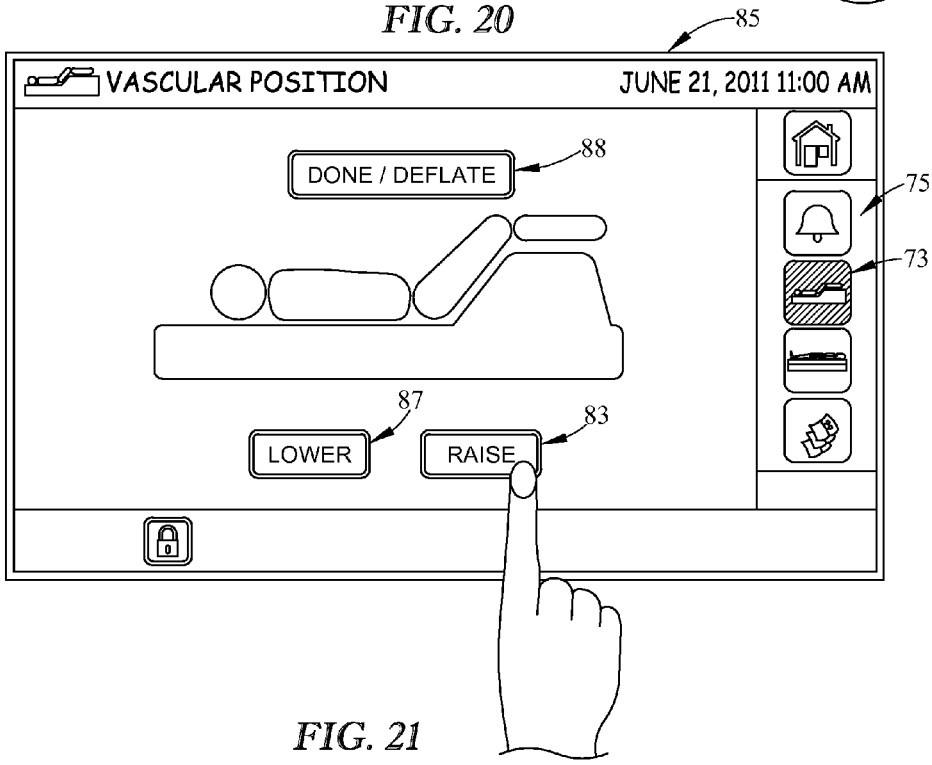
FIG. 21 is a vascular position screen from a user interface associated with the patient support system showing a user selecting a raise button used to initiate the vascular positioning operation performed by the inflatable patient positioning unit.

During the vascular positioning operation, each bladder 21, 22, 23, 24, 25 is inflated as desired by a caregiver as suggested in FIG. 20. However, even at the most elevated position, some (or all) of the bladders 21, 22, 23, 24, 25 are less than fully inflated to allow the patient's feet to fall down into the cushion during the vascular positioning operation as shown in FIG. 19.

The controller 60 is configured operate the valve box 48 and the pressurized air source 50 to inflate the positioner bladders 21, 22, 23, 24, 25 during the vascular positioning operation in response to receipt of a user input from the user interface 51. In the illustrative embodiment, a caregiver selects a vascular position button 73 from a menu 75 included in a home screen 70 displayed on the user interface 51 to access a vascular position screen 85 as suggested in FIG. 20. On the vascular position screen 85 (shown in FIG. 21), the caregiver selects a raise button 83 to initiate the vascular positioning operation. When the lower legs of a patient are lifted sufficiently, the caregiver releases the raise button 83. The positioner bladders 21, 22, 23, 24, 25 can be partially deflated by pressing a lower button 87 or completely deflated by pressing a done/deflate button 88 included in the vascular position screen 85.

Figure 22:
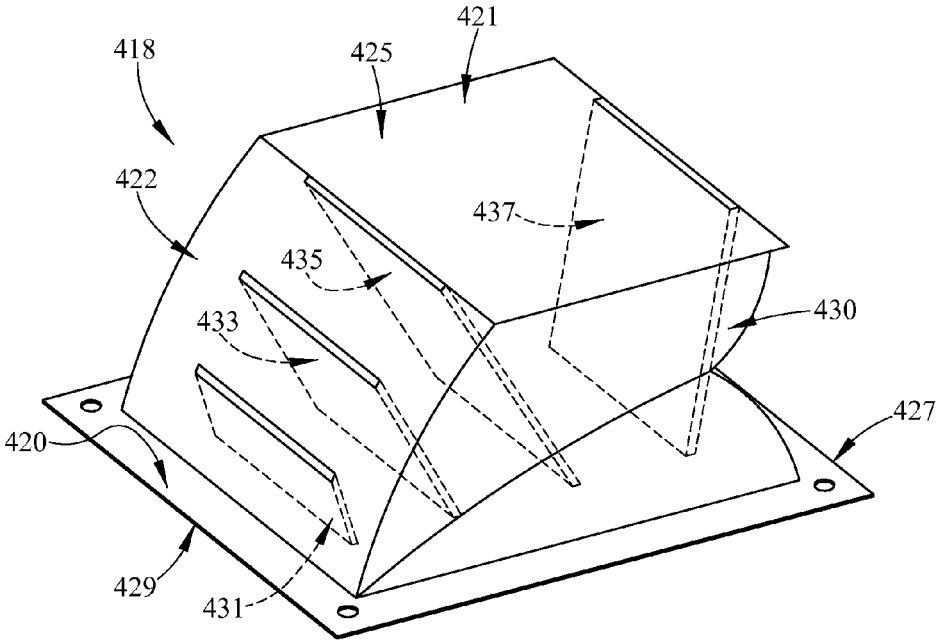
FIG. 22 is a perspective view of another inflatable patient positioning unit adapted to provide the vascular positioning operation showing that the inflatable patient positioning unit includes a single positioner bladder shaped so that when inflated a foot end of the positioner bladder is taller than a head end of the positioner bladder.

Another illustrative inflatable patient positioning unit 418 is shown in FIG. 22. The inflatable patient positioning unit 418 is configured for use in support surface 14 of patient support system 10 in place of inflatable patient positioning unit 18. The inflatable patient positioning unit 418 may be used to provide the vascular position operation described herein. The description of the patient support system 10 is hereby incorporated by reference to apply to the environment in which inflatable patient positioning unit 418 is used.

The inflatable patient positioning unit 418 includes a base sheet 420 and a single positioner bladder 421 shaped so that when inflated a foot end of the positioner bladder 421 is taller than a head end of the positioner bladder 421 as shown in FIG. 22. The positioner bladder 421 includes a ramp panel 422 coupled to the base sheet 420, a top panel 425 coupled to the ramp panel 422, and an expandable panel 430 as shown in FIG. 22. The positioner bladder 421 also includes a plurality of internally welded baffles 431, 433, 435, 437 adapted to support the shape of the positioner bladder 421 when inflated as shown in FIG. 22.

Figure 23:
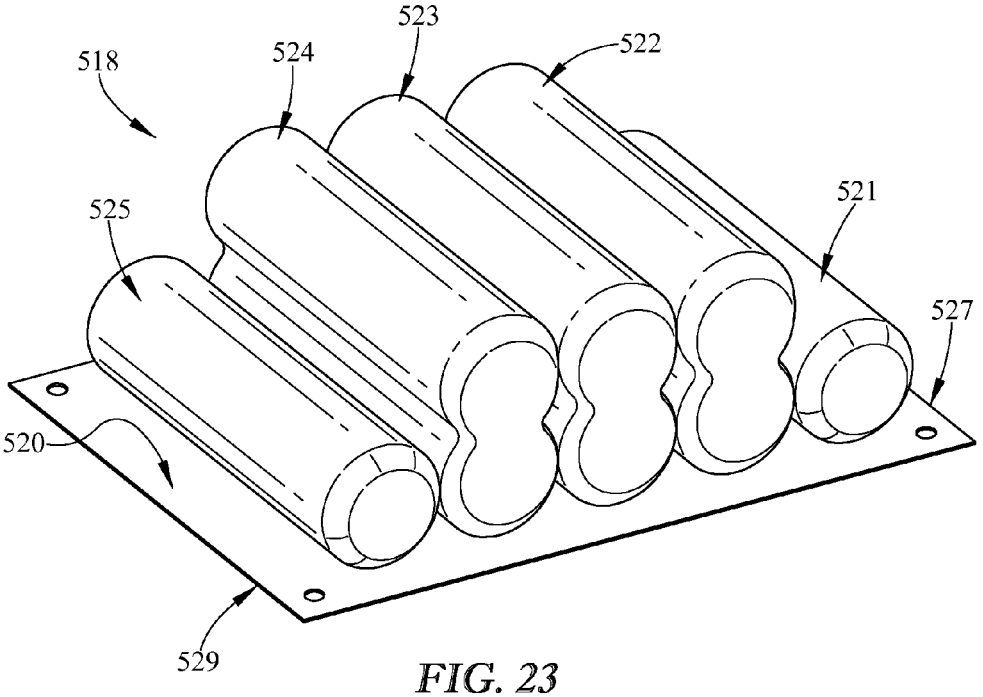
FIG. 23 is a perspective view of yet another inflatable patient positing unit adapted to provide the vascular positioning operation showing that the inflatable patient positioning unit includes a plurality of tubular bladders.

Yet another illustrative inflatable patient positioning unit 518 is shown in FIG. 23. The inflatable patient positioning unit 518 is configured for use in support surface 14 of patient support system 10 in place of inflatable patient positioning unit 18. The inflatable patient positioning unit 518 may be used to provide the vascular position operation described herein. The description of the patient support system 10 is hereby incorporated by reference to apply to the environment in which inflatable patient positioning unit 518 is used.

The inflatable patient positioning unit 518 includes a base sheet 520 and a plurality of positioner bladders 521, 522, 523, 524, 525 as shown in FIG. 23. The positioner bladders 521, 522, 523, 524, 525 cooperate to form a hump as shown in FIG. 23. In the illustrative embodiment, positioner bladder 521 located near the foot end 529 of inflatable patient positioning unit 518 and positioner bladder 525 located near head end 527 of inflatable patient positioning unit 518 are tubular and have a round cross-section. The positioner bladders 522, 523, 524 arranged between positioner bladders 521, 525 are tubular and have number 8-shaped cross-sections as shown in FIG. 23.

Figure 24:
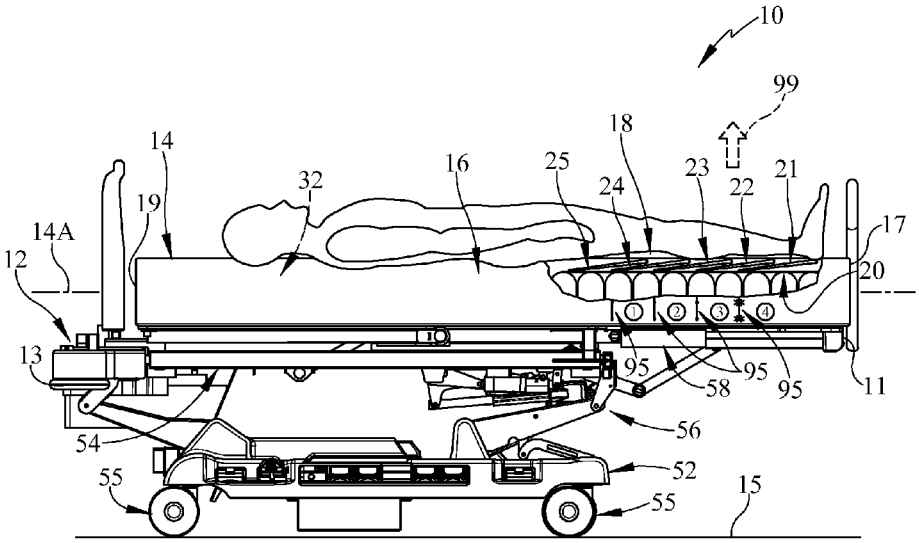
FIGS. 24-25 are a series of side elevation views of the patient support system of FIGS. 1-3 showing the inflatable patient positioning unit lifting the lower legs of a patient while allowing the feet of the patient to remain relatively unsupported as part of a heel relief operation.
Figure 25:
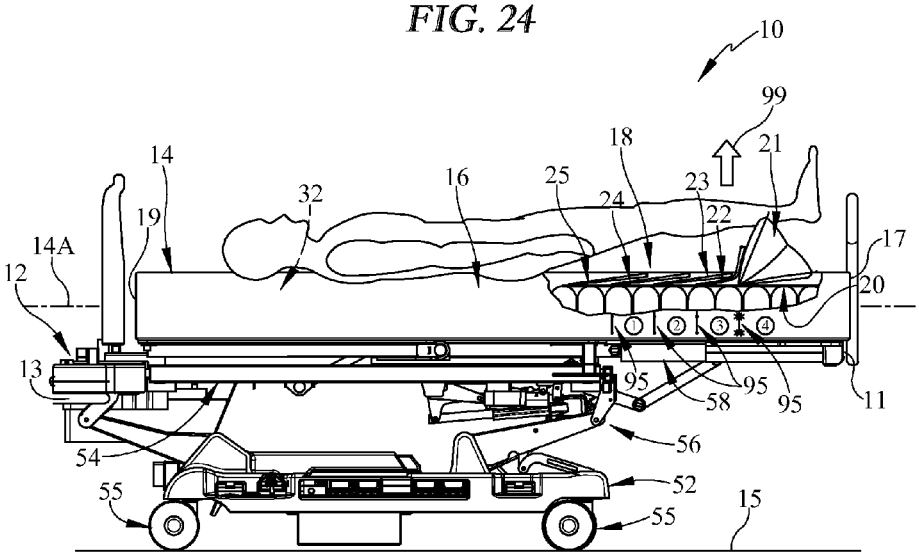
Figure 26:
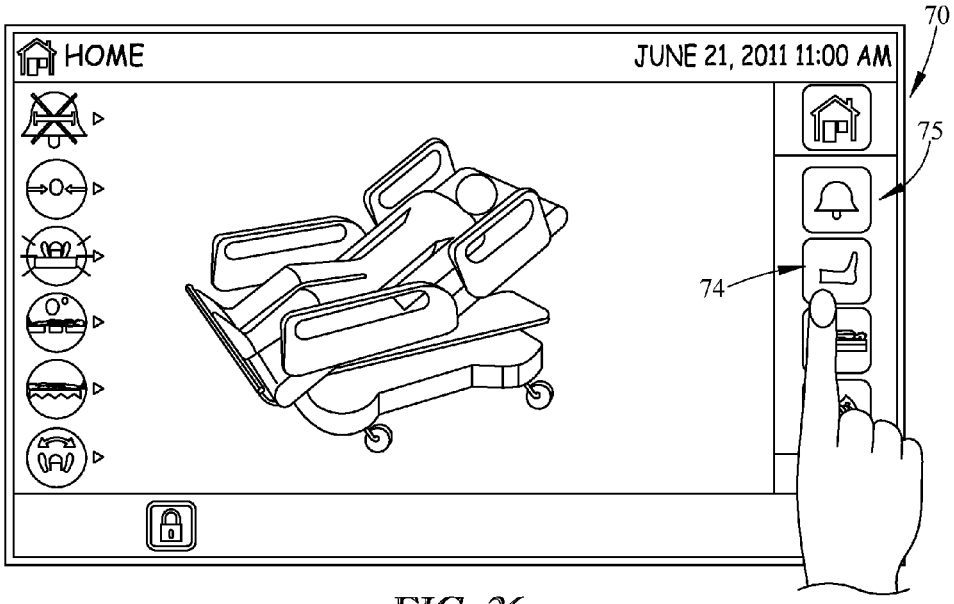
FIG. 26 is a home screen from a user interface associated with the patient support system showing a user selecting a heel relief button from a menu to access a heel relief screen as shown in FIG. 27.

A heel relief operation provided by the patient support system 10 lifts the lifts legs of a patient as suggested by arrow 99 while allowing the feet of the patient to remain relatively unsupported as shown in FIGS. 24 and 25. During the heel relief operation, the controller 60 is configured to operate the valve box 48 and the pressurized air source 50 to inflate one (or more) of the positioner bladders 21, 22, 23, 24, 25 included in the inflatable patient positioning unit 18.

Figure 27:
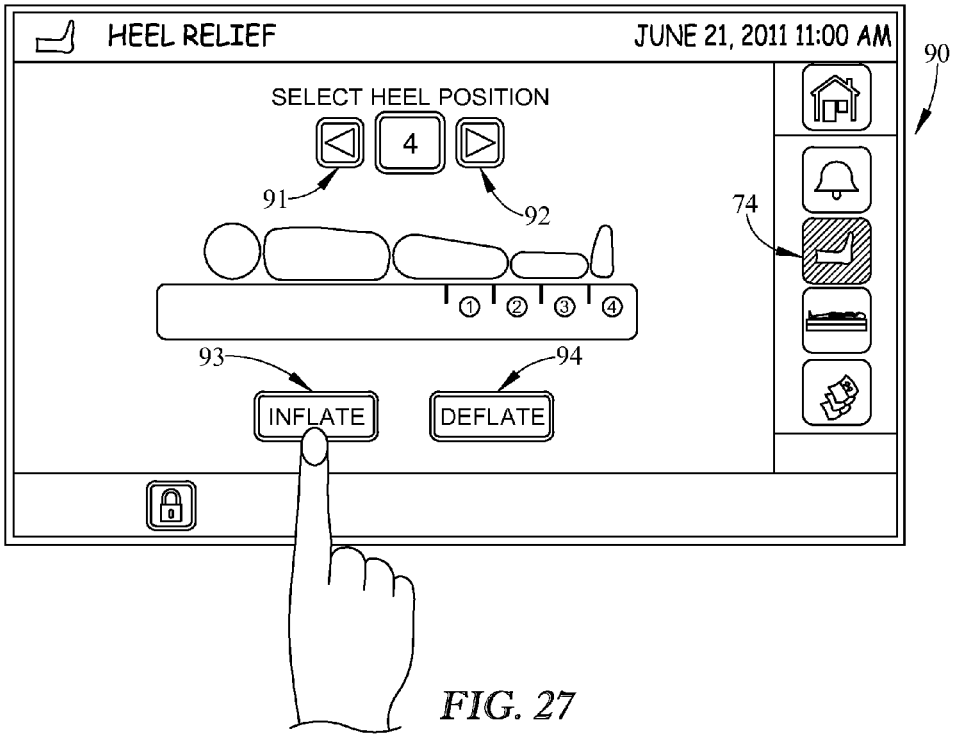
FIG. 27 is a heel relief screen from a user interface associated with the patient support system showing a user selecting an inflate button used to initiate the heel relief operation after selection of a patient heel position.

The controller 60 illustratively determines which of the positioner bladders 21, 22, 23, 24, 25 to inflate during the heel relief operation based on a heel position selection received from the user interface 51 as suggested in FIG. 27. In some embodiments, the support surface 14 may include a pressure sensitive pad 25 adapted to detect the position of a patient's heels and to light one of a series of LEDs 95 integrated into the support surface 14 as suggested in FIGS. 24 and 25. In other embodiments, controller 60 may determine which of the positioner bladders 21, 22, 23, 24, 25 to inflate during the heel relief operation based on a heel position identified from the pressure information provided by the pressure sensitive pad 25. The pressure sensitive pad 25 may be arranged along the top side of the support surface 14 as suggested in FIG. 4.

The controller 60 is configured operate the valve box 48 and the pressurized air source 50 to inflate a selected one (or more) of the positioner bladders 21, 22, 23, 24, 25 during the heel relief operation in response to receipt of a user input from the user interface 51. In the illustrative embodiment, a caregiver selects a heel relief button 74 from a menu 75 included in a home screen 70 displayed on the user interface 51 to access a heel relief screen 90 as suggested in FIG. 26. On the heel relief screen 90 (shown in FIG. 27), the caregiver selects a heel position using selection buttons 91 and 92. The caregiver then selects an inflate button 93 to initiate the heel relief operation. When the lower legs of a patient are lifted sufficiently, the caregiver releases the inflate button 93. The positioner bladders 21, 22, 23, 24, 25 are deflated by pressing a deflate button 94 included in the heel relief screen 90.

Although certain illustrative embodiments have been described in detail above, variations and modifications exist within the scope and spirit of this disclosure as described and as defined in the following claims.

The invention claimed is:

1. A patient support surface comprising a cushion adapted to support a patient and an inflatable patient positioning unit arranged over a portion of a top side of the cushion at a foot end of the cushion, the inflatable patient positioning unit including a plurality of positioner bladders, wherein each positioner bladder is U-shaped opening toward a head end of the cushion when viewed from above.

2. The patient support surface of claim 1, wherein positioner bladders of the inflatable patient positioning unit are arranged to overlap one another between a head end and a foot end of the inflatable patient positioning unit when the positioner bladders are deflated.

3. The patient support surface of claim 1, wherein each positioner bladder includes a bottom panel, a top panel coupled to the bottom panel along the proximal end of the positioner bladder to hold the top panel in place relative to the bottom panel along the proximal end of the positioner bladder during inflation of the positioner bladder, and an expandable panel coupled between the top panel and the bottom panel along the distal end of the positioner bladder to accommodate movement of the top panel away from the bottom panel along the distal end of the positioner bladder during inflation of the positioner bladder.

4. The patient support surface of claim 3, wherein the expandable panel is coupled between the top panel and the bottom panel along left and right sides of the positioner bladder to accommodate movement of the top panel away from the bottom panel along the left and right sides of the positioner bladder during inflation of the positioner bladder.

5. The patient support surface of claim 3, wherein the expandable panel of each positioner bladder is formed to include at least one pleat to accommodate movement of the top panel away from the bottom panel along the foot end of the positioner bladder during inflation of the positioner bladder.

6. The patient support surface of claim 1, wherein the cushion includes a plurality of support bladders arranged under the patient positioning unit.

7. The patient support surface of claim 6, further comprising a plurality of percussion bladders arranged over the plurality of support bladders included in the cushion and arranged between the patient positioning unit and the head end of the cushion.

8. The patient support surface of claim 6, further comprising a ticking encasing the cushion and the patient positioning unit.

9. A patient support surface comprising a cushion adapted to support a patient and an inflatable patient positioning unit arranged over a portion of a top side of the cushion at a foot end of the cushion, the inflatable patient positioning unit including a plurality of positioner bladders shaped so that when inflated a distal end of each positioner bladder is taller than a proximal end of the positioner bladder, wherein each positioner bladder is U-shaped opening toward a head end of the cushion when viewed from above.

10. A patient support system comprising a pressurized air source, a support surface including a cushion adapted to support a patient, an inflatable patient positioning unit arranged over a portion of a top side of the cushion at a foot end of the cushion, and a plurality of percussion bladders coupled pneumatically to the pressurized air source and are arranged over the cushion between the patient positioning unit and the head end of the cushion, the inflatable patient positioning unit including a plurality of positioner bladders coupled pneumatically to the pressurized air source, each of the plurality of positioner bladders, and a controller coupled to the pressurized air source, the controller configured to operate the pressurized air source to inflate the positioner bladders included in the inflatable patient positioning unit, to inflate the positioner bladders included in the inflatable patient positioning unit in a generally sequential order so that the inflatable patient positioning unit creates a wave moving from the foot end of the inflatable patient positioning unit toward the head end of the inflatable patient positioning unit to push a patient lying on the support surface toward a head end of the cushion, and to operate the pressurized air source to inflate the plurality of percussion bladders in response to initiation of inflation of the positioner bladders included in the inflatable patient positioning unit in a generally sequential order so that the torso of a patient lying on the support surface vibrates relative to the cushion resulting in decreased static friction between the torso of the patient and the support surface.

11. The patient support system of claim 10, further comprising a user interface coupled to the controller and adapted to receive user inputs, wherein the controller is configured operate the pressurized air source to inflate the positioner bladders included in the inflatable patient positioning unit in response to receipt of a user input from the user interface associated with a push up in bed operation.

12. The patient support surface of claim 10, wherein the positioner bladders of the inflatable patient positioning unit are arranged to overlap one another between a head end and a foot end of the inflatable patient positioning unit when the positioner bladders are deflated.

13. The patient support surface of claim 10, further comprising a user interface coupled to the controller and adapted to receive user inputs, wherein the controller is configured to operate the pressurized air source to inflate the positioner bladders and to inflate the plurality of percussion bladders in response to receipt of a user input from the user interface associated with a push up in bed function.

14. The patient support surface of claim 10, wherein the support surface includes a ticking encasing the cushion, the inflatable patient positioning unit, and the plurality of percussion bladders.

15. The patient support system of claim 10, further comprising a user interface coupled to the controller and adapted to receive user inputs, wherein the controller is configured to inflate the positioner bladders included in the inflatable patient positioning unit at generally the same time so that the patient positioning unit provides a hump adapted to reposition the lower leg and foot of a patient in a plane above the top side of the cushion in response to receipt of a user input from the user interface associated with a vascular position operation.

16. The patient support system of claim 10, wherein the controller is configured to inflate one of the positioner bladders included in the inflatable patient positioning unit arranged under a patient's lower legs so that the patient positioning unit supports the lower legs while the feet of the patient are unsupported to provide heel relief to the patient.

17. The patient support system of claim 16, further comprising a user interface coupled to the controller and adapted to receive user inputs, wherein the controller is configured to inflate one of the positioner bladders included in the inflatable patient positioning unit in response to receipt of a user input from the user interface associated with a heel relief operation.

18. The patient support system of claim 16, further comprising a sensor coupled to the controller and configured to determine a position of the feet of a patient supported on the support surface, wherein the controller is configured to inflate one of the positioner bladders included in the inflatable patient positioning unit in response to receipt of a user input from the user interface associated with a position of the feet of a patient lying on the support surface.

19. The patient support system of claim 18, wherein the sensor includes a pressure-sensitive pad adapted to map the pressure profile of a patient lying on the support surface.

20. A method of pushing a patient up in bed comprising inflating sequentially a plurality of positioner bladders included in an inflatable patient positioning unit arranged at a foot end of a support surface to create a wave moving from a foot end of the inflatable patient positioning unit toward a head end of the inflatable patient positioning unit and inflating a plurality of percussion bladders arranged to underlie a torso of a patient lying on the support surface during at least some time during inflation of the positioner bladders in response to initiation of inflation of the positioner bladders so that the torso of the patient lying on the support surface vibrates relative to the cushion decreasing static friction between the torso of the patient and the support surface.

21. A method of pushing a patient up in bed comprising inflating sequentially a plurality of positioner bladders included in an inflatable patient positioning unit arranged at a foot end of a support surface to create a wave moving from a foot end of the inflatable patient positioning unit toward a head end of the inflatable patient positioning unit and inflating a plurality of percussion bladders arranged to underlie a torso of a patient lying on the support surface during at least some time during inflation of the positioner bladders so that the torso of the patient lying on the support surface vibrates relative to the cushion decreasing static friction between the torso of the patient and the support surface, wherein each positioner bladder is shaped so that when inflated a distal end of the positioner bladder is taller than a proximal end of the positioner bladder.

* * * * *

UNITED STATES PATENT AND TRADEMARK OFFICE

CERTIFICATE OF CORRECTION

PATENT NO. : 9,259,098 B2
APPLICATION NO. : 14/098626
DATED : February 16, 2016
INVENTOR(S) : Joshua A. Williams et al.

It is certified that error appears in the above-identified patent and that said Letters Patent is hereby corrected as shown below:

In the Claims,

Column 13, lines 58-60, in claim 11, the recitation "configured operate the pressurized air source to inflate the positioner bladders", should be corrected to --configured to operate the pressurized air source to inflate the positioner bladders--.

Signed and Sealed this
Fourteenth Day of June, 2016

Michelle K. Lee

Michelle K. Lee
*Director of the United States Patent and Trademark Office*